US005782089A

United States Patent [19]

Machida et al.

[11] Patent Number: 5,782,089

[45] Date of Patent: Jul. 21, 1998

[54] HONEYCOMB CATALYTIC CONVERTER

[75] Inventors: Minoru Machida; Toshihiko Hijikata; Masashi Yano, all of Nagoya, Japan

[73] Assignee: NGK Insulators, Ltd., Japan

[21] Appl. No.: 590,862

[22] Filed: Jan. 24, 1996

[30] Foreign Application Priority Data

Jan. 26, 1995 [JP] Japan ..... 7-010436

[51] Int. Cl.[6] ..... F01N 3/28

[52] U.S. Cl. ..... 60/299; 422/179; 422/180

[58] Field of Search ..... 60/299; 422/179, 422/180, 176

[56] References Cited

U.S. PATENT DOCUMENTS

| | | | |
|---|---|---|---|
| 4,002,433 | 1/1977 | Oser | 60/299 |
| 4,043,761 | 8/1977 | Gaysert | 422/179 |
| 5,094,073 | 3/1992 | Worner | 60/299 |
| 5,250,269 | 10/1993 | Langer | 422/180 |

FOREIGN PATENT DOCUMENTS

| | | | |
|---|---|---|---|
| 0472009 | 2/1992 | European Pat. Off. . | |
| 2703105 | 9/1994 | France . | |
| 9210836 | 11/1992 | Germany . | |
| 55-130012 | 9/1980 | Japan . | |
| 56-67314 | 6/1981 | Japan . | |
| 41414 | 3/1982 | Japan | 60/299 |
| 62-171614 | 10/1987 | Japan . | |

*Primary Examiner*—Douglas Hart

*Attorney, Agent, or Firm*—Parkhurst & Wendel

[57] ABSTRACT

In a honeycomb catalytic converter having a metal case, a honeycomb catalyst mounted in the metal case, and a securing member used for mounting the honeycomb catalyst in the metal case and arranged between an outer surface of the honeycomb catalyst and an inner surface of the metal case, at lest one of an inlet portion and outlet portion of the honeycomb catalyst has a double cone structure in which an inner cylindrical member is arranged in the metal case. The honeycomb catalytic converter mentioned above can mount the honeycomb catalyst stably in the metal case for a long period of time even when exposed to high temperatures.

7 Claims, 5 Drawing Sheets

HONEYCOMB CATALYTIC CONVERTER

BACKGROUND OF THE INVENTION

1. Field of the Invention

The present invention relates to a honeycomb catalytic converter used for purifying, for example, exhaust gas of automobiles.

2. Related Art Statement

Honeycomb catalytic converters have been widely used for exhaust gas purifying systems in automobiles as shown, for example, in Japanese Utility-Model Laid-open Publication No. 56-67314, Japanese Utility-Model Laid-open Publication No. 62-171614. The honeycomb catalyst converter comprises a metal case, a honeycomb catalyst mounted in the metal case, and a securing member for maintaining the honeycomb catalyst in the metal case, which is arranged between an outer surface of the honeycomb catalyst and an inner surface of the metal case.

Recently, exhaust gas regulation for automobiles has become stricter, and thus automobile designers have attempted to arrange the catalytic converter closer to the engine whereby the temperature of the exhaust gas is high or to provide a high temperature exhaust gas for increasing catalytic properties. Moreover, in order to satisfy $CO_2$ regulation, fuel consumption and so on, combustion in a high speed range is performed at near theoretical stoichiometric ratio, and thus a temperature of the exhaust gas in the high speed range is increased. Under such circumstances, operating conditions of the catalytic converter become affected by thermal properties year by year. Therefore, in the operating conditions mentioned above, an outer surface of the catalytic converter tends to be at a high temperature, and thus heat of the catalytic converter is affected to surrounding members. In order to solve this problem, a metal cover is sometimes arranged at an outer portion of the metal case so as to prevent such a heat radiation.

FIG. 10 shows one embodiment of the metal cover. In the embodiment shown in FIG. 10, a catalytic converter 20 is constructed by mounting a honeycomb catalyst 21 in a metal case 22. The honeycomb catalyst 21 is constructed by a honeycomb structural body having a plurality of flow passages through which an exhaust gas from an internal combustion engine is passed, and a catalyst is coated on the honeycomb structural body. In order to mount the honeycomb catalyst 21 in the metal case, a securing member 23 made of a ceramic fiber mat is arranged in a compressed state between an outer surface of the honeycomb catalyst 21 and an inner surface of the metal case 22. Moreover, a seal member 24 made of a stainless wire net is arranged on at least one end, both ends in this embodiment, of the securing member 23 so as to prevent a scattering of the securing member 23 due to the exhaust gas flow.

In addition, a metal case cover 25 is arranged at an overall outer portion of the metal case 22, so that an air insulation layer 26 is created between the metal case 22 and the metal case cover 25. In this case, an insulation member may be arranged between the metal case 22 and the metal case cover 25 if necessary. Moreover, a flange member 27 used for a connection with an exhaust pipe is arranged at both end portions of the metal case 22 and the metal case cover 25. The flange member 27 is connected to the metal case 22 and the metal case cover 25 by means of a welding or the like.

In the known catalytic converter 20 having the construction mentioned above, since the metal case cover 25 is arranged around the metal case 22 and the metal case 22 is not brought into contact with the ambient air, the metal case 22 is not easily cooled down. Therefore, the metal case 22 increases to a high temperature and expands, and thus a space is generated between the metal cover 22 and the honeycomb catalyst 21, so that a mounting force of the securing member 23 is decreased. Moreover, an expansive securing member having an excellent property as the securing member 23 and used widely for the securing member 23 has a low heat resistivity. Therefore, if the expansive securing member is used as the securing member 23 of the catalytic converter 20 used under high temperature, the securing member 23 loses its expansive property and thus a mounting force of the securing member 23 is also decreased. Therefore, in the known catalytic converter 20, there occurs a concern such that the honeycomb catalyst 21 is moved in the metal case 22 due to an engine vibration, a vibration during a vehicle running or the like, and thus an abrasion and a failure of the honeycomb catalyst 21 may occur.

SUMMARY OF THE INVENTION

An object of the present invention is to eliminate the concerns mentioned above and to provide a honeycomb catalytic converter in which a honeycomb catalyst can be stably mounted in a metal case for a long time even in high temperatures.

According to the invention, a honeycomb catalytic converter having a metal case, a honeycomb catalyst mounted in said metal case, and a securing member used for mounting said honeycomb catalyst in said metal case and arranged between an outer surface of said honeycomb catalyst and an inner surface of said metal case, is characterized in that at lest one of an inlet portion and an outlet portion of said honeycomb catalyst has a double cone structure in which an inner cylindrical member is arranged in said metal case.

In the construction mentioned above, since at least one of the inlet portion and the outlet portion of the honeycomb catalyst has a double cone structure in which an inner cylindrical member is arranged in the metal case, an exhaust gas having a high temperature is not directly brought into contact with the outer metal case at the double cone structure portion. On the other hand, since the metal case, to which the securing member is contacted, has no double structure, the overall metal case can be directly cooled by the ambient air from this portion of the metal case, and thus a temperature of an outer surface of the metal case can be maintained in a low temperature. Therefore, it is possible to prevent a heat affection to the surrounding members. Moreover, since an expansion of the metal case can be reduced, it is possible to prevent a heat deterioration of the securing member by increasing a temperature. As a result, the honeycomb catalyst is not moved in the metal case due to a decrease of mounting force of the securing member, and thus it is possible to prevent an abrasion and a failure of the honeycomb catalyst.

Moreover, according to the invention, since a temperature of an outer surface of the metal case can be maintained in a low temperature, it is not necessary to use a heat shielding cover arranged around the metal case, and thus an outer diameter of the honeycomb catalyst can be enlarged. Therefore, it is possible to reduce a pressure drop when an exhaust gas is passed through the honeycomb catalyst. In addition, if an outer diameter of the honeycomb catalyst becomes larger, a volume thereof becomes larger correspondingly, and thus a purifying performance can also be improved.

DESCRIPTION OF THE PREFERRED EMBODIMENTS

Figure 1:
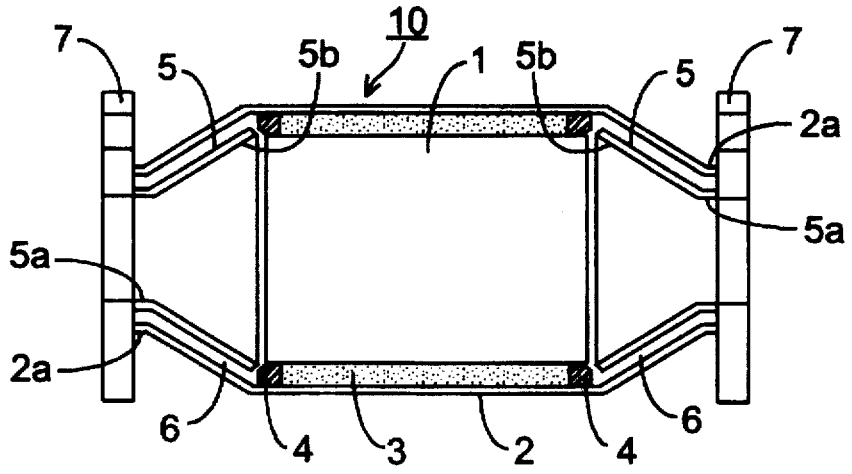
FIG. 1 is a schematic view showing one embodiment of a honeycomb catalytic converter according to the invention.

FIG. 1 is a schematic view showing one embodiment of a honeycomb catalytic converter according to the invention. In the embodiment shown in FIG. 1, a catalyst converter 10 is constructed by mounting a honeycomb catalyst 1 in a metal case 2. The honeycomb catalytic 1 is constructed by a honeycomb structural body having a plurality of flow passages through which exhaust gas from an internal combustion engine is passed, and a catalyst is coated on the honeycomb structural body. In order to mount the honeycomb catalyst 1 in the metal case 2, a securing member 3 made of an expansive ceramic fiber such as a ceramic fiber mat is arranged in a compressed state between an outer surface of the honeycomb catalyst 1 and an inner surface of the metal case 2. Moveover, a seal member 4 is arranged at least one end (both ends in FIG. 1) of the securing member 3 so as to prevent a scattering of the securing member 3 due to the exhaust gas flow. The seal member 4 is made of a stainless wire net or a member in which stainless wire net is covered with a ceramic fiber.

It is an important feature of the present invention that at least one of an inlet portion and an outlet portion (both portions in FIG. 1) of the honeycomb catalyst 1 has a double cone structure in which an inner cylindrical member 5 made of a metal is arranged in the metal case 2. Moreover, in this embodiment, an air heat insulation layer 6 is created between the metal case 2 and they cylindrical member 5. If necessary, a heat insulation member may be arranged between the metal case 2 and the cylindrical member 5.

Further, a flange member 7 used for a connection with an exhaust pipe is arranged at both end portions 2*a* and 5*a* of the metal case 2 and the cylindrical member 5. The flange member 7 is connected to the metal case 2 and the cylindrical member 5 by means of a welding or the like. Moveover, if a ceramic cylindrical member 5 is used for improving heat shielding properties, a securing member is arranged in the air heat insulation layer 6 between the cylindrical member 5 and the metal case 2 so as to fix the cylindrical member 5.

In addition, the other end 5*b* of the cylindrical member 5 connected to the flange member 7 is not directly contacted with to the metal case 2. Therefore, if the cylindrical member 5 increases in temperature due to contact with an exhaust gas having a high temperature, it is possible to reduce a heat conduction from the cylindrical member 5 to the metal case 2. As a result, an outer surface of the honeycomb catalytic converter can be maintained at a low temperature, and thus it is possible to prevent a heat affection to the surrounding members. The honeycomb structural body used as the catalyst carrier of the honeycomb catalyst 1 may be made of ceramics such as cordierite and so on or may be made of a metal such as a stainless steel and so on. In addition, it is no problem that there may be a little space between the end portion 5*b* and the seal member 4. However, it is preferred to contact the end portion 5*b* with the seal member 4 so as not to flow an exhaust gas having a high temperature into the space.

FIGS. 2 to 5 are schematic views showing respectively other embodiments of the honeycomb catalytic converter according to the invention. All the embodiments shown in FIGS. 2 to 5 have basically the same construction shown in FIG. 1. Therefore, in the embodiments shown in FIGS. 2 to 5, the same portions as those of FIG. 1 are denoted by the same reference numerals, and the explanations thereof are omitted here. Moreover, in the embodiments shown in FIGS. 2 to 5, the same effects as is the same as the embodiment shown in FIG. 1 are obtained in the same manner.

Figure 2:
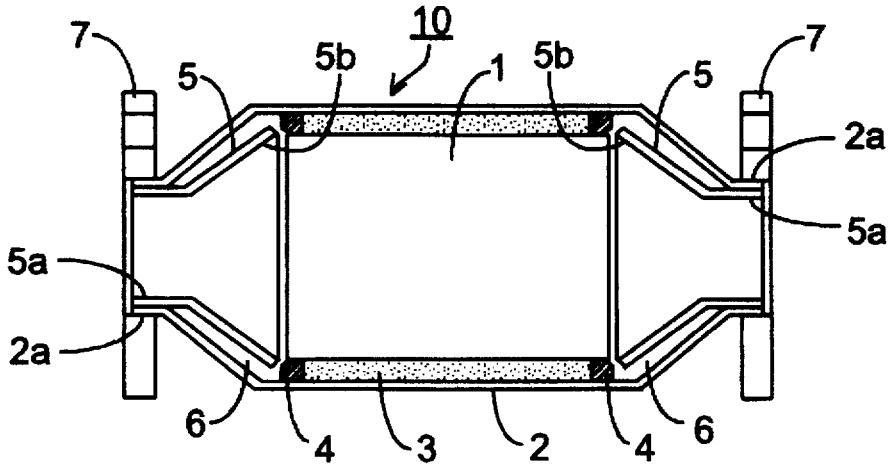
FIG. 2 is a schematic view showing another embodiment of the honeycomb catalytic converter according to the invention.
Figure 3:
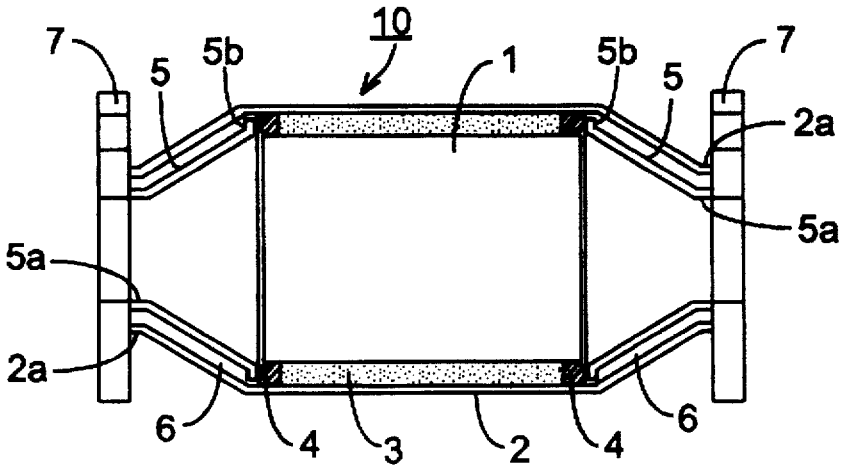
FIG. 3 is a schematic view showing still another embodiment of the honeycomb catalytic converter according to the invention.

In the embodiment shown in FIG. 2, the end portion 2*a* of the metal case 2 and the end portion 5*a* of the cylindrical member 5, which construct the double cone structure, are connected beforehand and is different from the embodiment shown in FIG. 1. Therefore, in the embodiment shown in FIG. 2, the number of the welding portions with the flange member 7 can be reduced, and thus it is possible to reduce a cost. In the embodiment shown in FIG. 3, the end portion 5*b* of the cylindrical member 5 is connected to the metal case 2 by means of a point welding and is different from the embodiment shown in FIG. 1. Therefore, in the embodiment shown in FIG. 3, it is possible to prevent a failure of the cylindrical member 5 due to a vibration by the engine or the like. On the other hand, since the end portion 5*b* of the cylindrical member 5 is contacted with the metal case 2, there may be a little heat conduction from the cylindrical member 5 to the metal case 2. However, since the connection between the end portion 5*b* and the metal case 2 is performed by means of a point welding, a temperature increase of the outer surface of the metal case 2 is no problem in an actual use.

Figure 4:
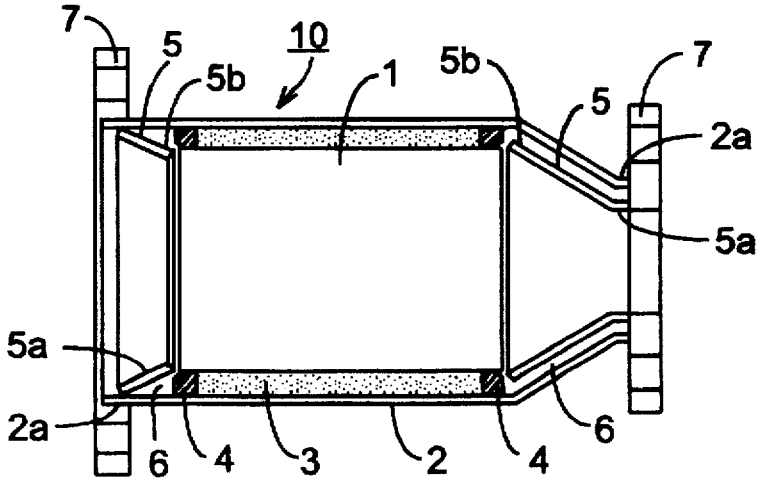
FIG. 4 is a schematic view showing still another embodiment of the honeycomb catalytic converter according to the invention.
Figure 5:
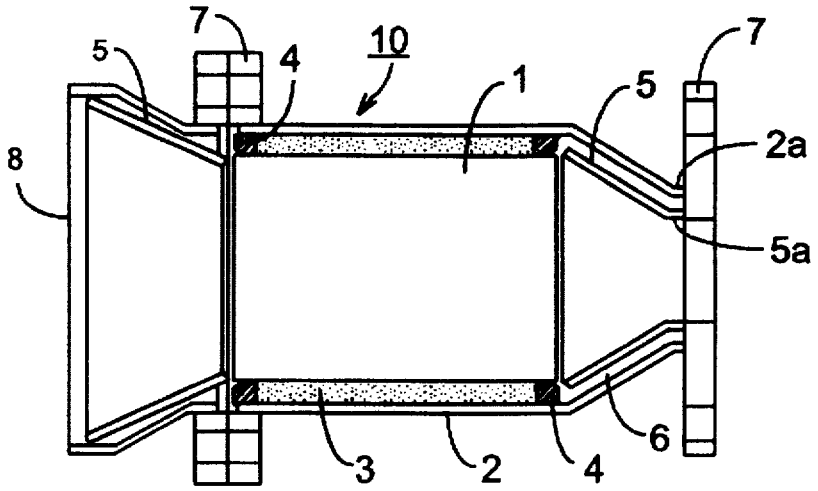
FIG. 5 is a schematic view showing still another embodiment of the honeycomb catalytic converter according to the invention.

In the embodiments shown in FIGS. 4 and 5, the honeycomb catalytic converter 10 according to the invention is directly connected to a pipe gathering portion of an exhaust manifold of the engine. Therefore, in the embodiments shown in FIGS. 4 and 5, and opening of the flange member 7 at an inlet side is larger than that of the flange member 7 at an outlet side. Moreover, in order to improve a purifying performance at a low temperature engine start by maintaining a high temperature exhaust gas flowing into the honeycomb catalytic converter 10, a length from an inlet of the honeycomb catalytic converter 10 to the honeycomb catalyst 1 is made as short as possible or substantially zero. In the embodiment shown in FIG. 5, since the cylindrical member 5 is not arranged in the metal case 2 at the inlet side, a pipe gathering portion 8 of the exhaust manifold is formed by the double cone structure.

Hereinafter, an actual embodiment will be explained.

EMBODIMENT

Figure 10:
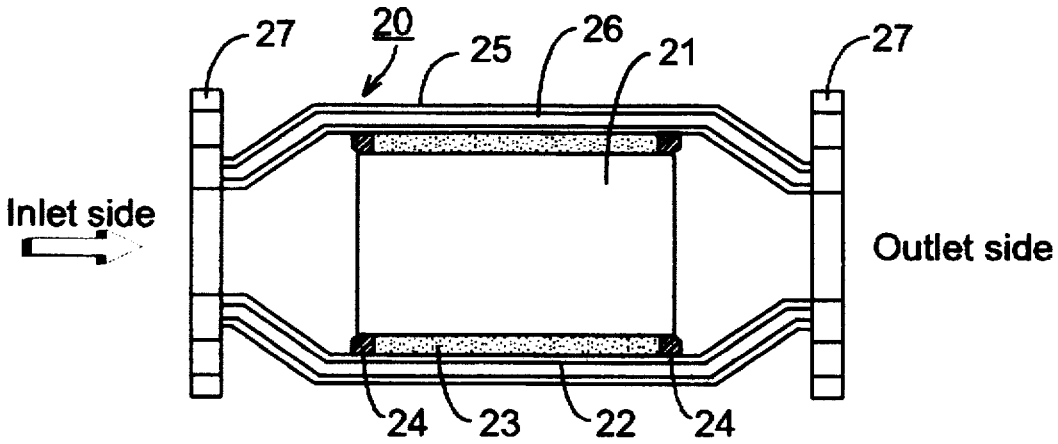
FIG. 10 is a schematic view showing one embodiment of a honeycomb catalytic converter according to a conventional example.

The honeycomb catalytic converter according to the invention having the construction shown in FIG. 1 and the honeycomb catalytic converter according to the comparative example having the construction shown in FIG. 10 were prepared. With respect to the thus prepared honeycomb catalytic converters, a temperature influence of a converter outer surface, a temperature influence of a securing member at a metal case side, a result of a hot vibration test and a measurement result of a pressure drop were compared with each other.

Figure 6:
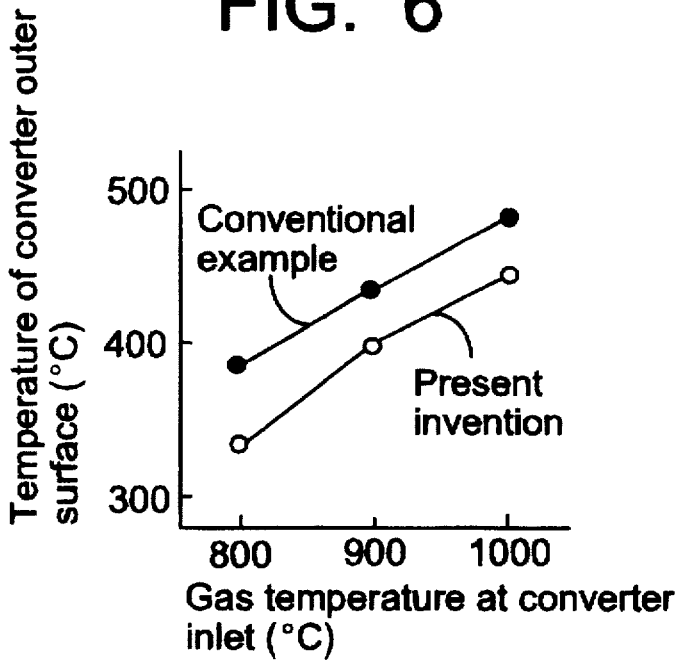
FIG. 6 is a graph showing a temperature influence to an outer surface of the converter in an experiment.
Figure 7:
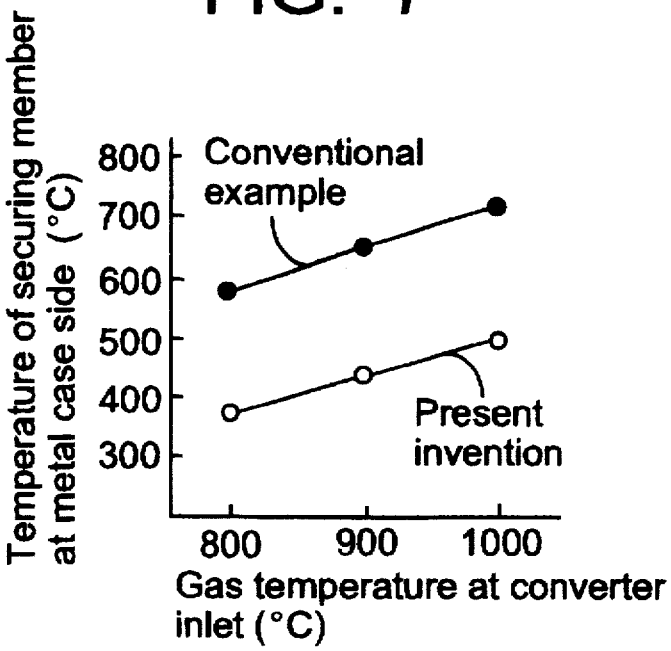
FIG. 7 is a graph showing a temperature influence to the securing member in the experiment.

The temperature influence of the converter outer surface was compared as follows. An inlet temperature of the honeycomb catalytic converter was varied by using a combustion air of a propane gas burner which simulated an exhaust gas of the engine under such a condition that a flow rate of the combustion air was always maintained at 2 $Nm^3$/min. In this case, temperatures of the outer surface of the honeycomb catalytic converter were measured and compared. The results were shown in FIG. 6. From the results shown in FIG. 6, it was understood that a temperature of the honeycomb catalytic converter according to the invention was always decreased by several of 10° C. as compared with that of the honeycomb catalytic converter according to the comparative example, and that the honeycomb catalytic converter according to the invention could prevent a heat affection without using a metal case cover. Moreover, the temperature influence of the securing member at the metal case side was compared in such a manner that temperatures between the securing member 3(23) and the metal case 2(22) were measured under the same combustion air flowing condition mentioned above. The result was shown in FIG. 7. From the result shown in FIG. 7, it was understood that a temperature of the honeycomb catalytic converter according to the invention was decreased by almost 200° C. as compared with that of the honeycomb catalytic converter according to the comparative example, and that an expansion of the metal case and a temperature deterioration of the securing member were small.

Figure 8:
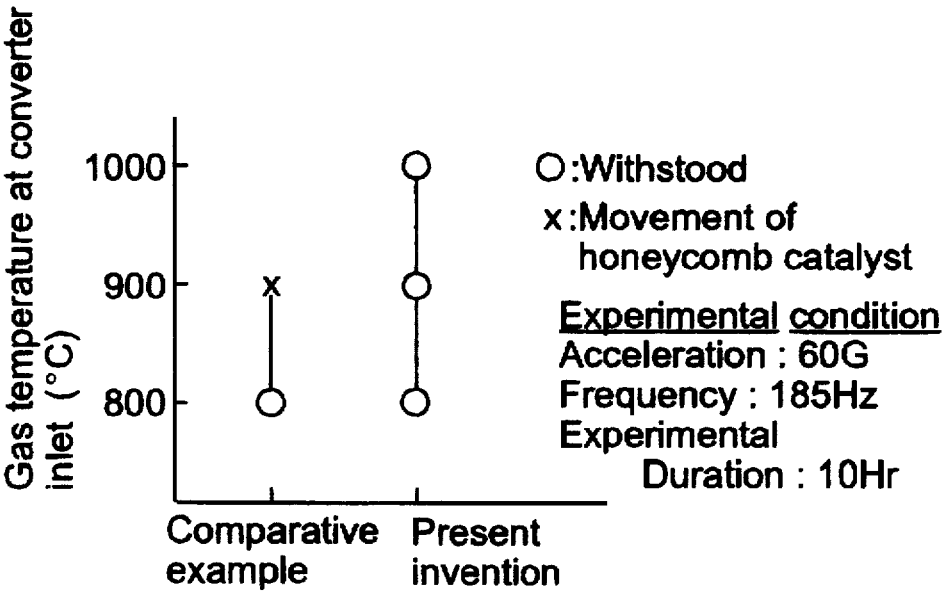
FIG. 8 is a graph showing a result of a hot vibration test in the experiment.

The hot vibration test was performed in such a manner that the honeycomb catalytic converter was vibrated under the same combustion air flow condition mentioned above. The vibration condition was that an acceleration was 60G and a frequency was 185 Hz. Then, the gas temperature of the inlet portion was stepped up from 800° C. by 100° C. such as 800° C., 900° C., 1000° C., and whether the honeycomb catalytic converter was normal at respective temperatures was observed. The result was shown in FIG. 8. From the result shown in FIG. 8, it was understood that, in both of the honeycomb catalytic converters according to the present invention and the comparative example, no abnormal one was not detected up to 800° C. However, in the honeycomb catalytic converter according to the comparative example, it was understood that the honeycomb catalytic was displaced in a converter axis direction at 900° C. On the other hand, in the honeycomb catalytic converter according to the present invention, it was understood that no abnormal one was detected even at 900° C. and 1000° C.

Figure 9:
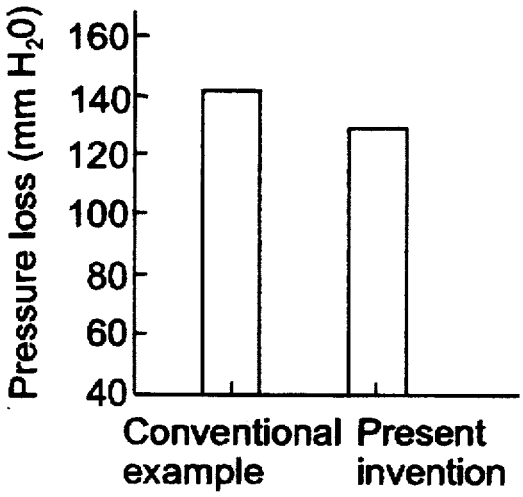
FIG. 9 is a graph showing a measurement result of a pressure drop in the experiment.

The pressure drop was measured under such a condition that an air of flow rate: 8 $Nm^3$/min. at a room temperature was passed through the honeycomb catalytic converters according to the present invention and the conventional example. In this case, a dimension of the honeycomb structural body used in the honeycomb catalyst according to the comparative example was that a diameter was 90 mm and a length was 90 mm, and a cell structure thereof was that a wall thickness was 6 mil and the number of cells was 400 pieces per square inch. On the other hand, a dimension of the honeycomb structural body according to the invention was that a diameter was 105 mm and a length was 90 mm, and a cell structure thereof was the same as that of the conventional example. Moreover, a largest outer diameter of the honeycomb catalytic converters according to the present invention and the comparative example was 120 mm. The result was shown in FIG. 9. From the result shown in FIG. 9, it was understood that the honeycomb catalytic converter according to the invention showed an excellent pressure drop as compared with the honeycomb catalytic converter according to the comparative example.

What is claimed is:

1. A honeycomb catalytic converter, comprising a metal case, a honeycomb catalyst mounted in said metal case, a securing member for mounting said honeycomb catalyst in said metal case and arranged between an outer surface of said honeycomb catalyst and an inner surface of said metal case, at least one of an inlet portion and an outlet portion of said converter having a double cone structure wherein said metal case comprises an outer cylindrical member and an inner cylindrical member is disposed concentrically therein, a circumferential gap of substantially constant size being defined by said outer and inner cylindrical members, and a flange being connected to each of said outer and inner cylindrical members, said flange maintaining an end portion of each of said outer and inner cylindrical members at a distance for each other corresponding to the size of the gap.

2. The honeycomb catalytic converter according to claim 1, wherein one end of said inner cylindrical member adjacent to said honeycomb catalyst is not brought into contact with said metal case.

3. The honeycomb catalytic converter according to claim 1, wherein a honeycomb structural body used in said honeycomb catalyst comprise ceramic material.

4. The honeycomb catalytic converter according to claim 1, wherein a honeycomb structural body used in said honeycomb catalyst comprised of a metal.

5. The honeycomb catalytic converter according to claim 1, wherein a heat insulation member is arranged in said gap between said metal case and said inner cylindrical member.

6. The honeycomb catalytic converter according to claim 1, wherein said cylindrical member comprises ceramic material.

7. The honeycomb catalytic converter according to claim 1, wherein said securing member is comprised of an expansive ceramic fiber.

* * * * *